US008112907B2

(12) United States Patent
Kim

(10) Patent No.: US 8,112,907 B2
(45) Date of Patent: Feb. 14, 2012

(54) DISPOSABLE CUSHION SHOE INSERT

(76) Inventor: Eric Byeung Kim, Woodmere, NY (US)

( * ) Notice: Subject to any disclaimer, the term of this patent is extended or adjusted under 35 U.S.C. 154(b) by 523 days.

(21) Appl. No.: 12/348,288

(22) Filed: Jan. 3, 2009

(65) Prior Publication Data

US 2010/0170117 A1 Jul. 8, 2010

(51) Int. Cl.
*A43B 13/38* (2006.01)

(52) U.S. Cl. ..... 36/44; 36/3 R

(58) Field of Classification Search ..... 36/3 R, 36/3 B, 43, 44
See application file for complete search history.

(56) References Cited

U.S. PATENT DOCUMENTS

| | | | | | |
|---|---|---|---|---|---|
| 2,865,097 | A * | 12/1958 | Vollrath, Jr. et al. | 36/43 |
| 3,231,454 | A * | 1/1966 | Williams | 428/132 |
| 4,185,402 | A * | 1/1980 | Digate | 36/44 |
| 4,257,176 | A * | 3/1981 | Hartung et al. | 36/44 |
| 4,336,661 | A * | 6/1982 | Medrano | 36/44 |
| 4,485,568 | A * | 12/1984 | Landi et al. | 36/44 |
| 5,845,418 | A * | 12/1998 | Chi | 36/3 B |
| 6,006,447 | A * | 12/1999 | Neal et al. | 36/3 B |
| 6,006,448 | A * | 12/1999 | Hellman | 36/11.5 |
| 6,839,984 | B2 * | 1/2005 | Polegato | 36/3 B |
| 7,703,219 | B2 * | 4/2010 | Beck | 36/44 |
| 2004/0159015 | A1 * | 8/2004 | Dennis et al. | 36/44 |
| 2008/0110064 | A1 * | 5/2008 | Liu | 36/3 B |
| 2008/0307679 | A1 * | 12/2008 | Chiang et al. | 36/3 B |
| 2010/0132228 | A1 * | 6/2010 | Polegato Moretti | 36/3 B |

FOREIGN PATENT DOCUMENTS

WO WO 2008125524 A1 * 10/2008

* cited by examiner

*Primary Examiner* — Marie Patterson

(57) ABSTRACT

The present invention is a disposable cushion inserts for shoes designed to temper forces imparted on a foot during activities such as walking and running. The cushion insert in one embodiment has first and second layers conjoined by a bonding method taken from the group of adhesive and ultrasonics. The first layer is constructed of fibrous material taken from the group of fiber crops and polymers that will be treated to have a low moisture content and absorbency with a plurality of air passages apertures passing between the second layer and the cushioned insert exterior. The second layer is manufactured from a cross-linked open cell silicone material having a plurality of conjoined truncated-apex square pyramids where the walls enclose a central cavity with open bottoms providing a structure that is mostly ambient air-filled space that when released from a compressed state returns to its original form. Each of the truncated-apex surfaces has an aperture placed therethrough providing passage for air between each of the pyramid-shaped cavities and the cushioned-insert exterior. Also provides is an embodiment having a base layer conjoined to the second layer manufactured from a frictional material to prevent slippage of the cushioned insert during use.

9 Claims, 8 Drawing Sheets

DISPOSABLE CUSHION SHOE INSERT

BACKGROUND OF THE INVENTION

1. Field of the Invention

The present invention relates generally to shoe inserts and, more specifically, to disposable cushion inserts for shoes designed to temper forces imparted on a foot during activities such as walking and running.

The cushion insert in one embodiment has a cover layer and an open-cell shape-retentive layer conjoined by means of a bonding method taken from the group of adhesive and ultrasonics.

The cover layer is constructed of fibrous material taken from the group of fiber crops and polymers that will be treated to have a low moisture content and absorbency with a plurality of apertures passing therethrough as air passages between the open-cell layer and the cushioned insert exterior.

The second layer is manufactured from a cross-linked open cell silicone material having a plurality of conjoined truncated-apex square pyramids where the walls enclose a central cavity with open bottoms providing a structure that is mostly ambient air-filled space that when released from a compressed state returns to its original form. Each of the pyramids' truncated-apex top surfaces has an aperture placed therethrough providing passage for air between each of the pyramid-shaped cavities and the cushioned-insert exterior.

The aforementioned bonding of the cover and open-cell layers takes place between the top planar surfaces of the apex-truncated pyramids and the surface area of the first layer engaging the apex-truncated pyramids.

As aforementioned, both the cover and open-cell layers have a plurality of apertures with the pyramid apex apertures co-aligning with the cover layer apertures. Additional apertures are placed in the cover layer in fluid communication with the spaces between the second layer's spaced apart pyramids providing for additional venting of air from the open-cell layer through the cover to the cushioned insert exterior.

The present invention also provides for an embodiment having a base layer conjoined to the base of the open-cell layer manufactured from a frictional material to prevent slippage of the cushioned insert during use.

2. Description of the Prior Art

There are other shoe inserts designed for similar purposes. While these shoe inserts may be suitable for the purposes for which they were designed, they would not be as suitable for the purposes of the present invention, as hereinafter described.

U.S. Pat. No. 231,398 of Bussey discloses air cavities covered by an insole with smaller holes but does not teach a collapsible structure with superadjacent apertures for channeling air across the foot.

U.S. Pat. No. 682,141 of Galloway teaches a shoe cushion insert with exterior venting air pockets with channels between the air pockets for venting. This design would result in a lumpy insert due to the varying cross sectional thicknesses of the insert.

U.S. Pat. No. 825,515 of Byrne discloses a dual layer insert having a plurality of imperforate frusto conical air pockets that would entrap air as a cushioning member while venting the air below along the periphery. It does not teach an insert that would unilaterally collapse expelling all air contained therein.

U.S. Pat. No. 1,128,220 of Bullard discloses an insert comprised of independent cells that vent out the bottom of the insert. It is believed that sufficient pressure would keep the cells from venting at all. Furthermore, such a design would be limited to a heel cushion as shown since a full shoe insert would cause pressure and soreness across the instep due to the contour of the foot.

U.S. Pat. No. 1,605,408 of Huiskamp teaches a permanent air cushion positioned between the inner and outer sole with a plurality of protuberances and a single ingress and egress port positioned in the insole. Such a design would have limited capability of moving air across the body of the foot.

U.S. Pat. No. 2,090,881 of Wilson teaches a bubble-wrap type insert with sealed air pockets which does not provide for the exchange of air within the insert due to changes in pressure.

U.S. Pat. Nos. 2,347,207 and 2,432,533 of Margolin teaches an insole with a plurality of hexagonal shaped pockets with exterior opening for moving air in and out of the insert. The insert does not disclose a disposable insert having a wall structure creating an interior ventable compartment and an exterior ventable compartment.

U.S. Pat. No. 3,231,454 of Williams teaches a cushioning material with a plurality of spaced columnar-shaped projections. The cushioning material does not disclose a wall structure creating an interior ventable compartment and an exterior ventable compartment.

U.S. Pat. No. 3,589,037 of Gallagher teaches a plurality of air pockets formed from heat sealing two sheets together, which does not provide for air movement from the insert during activity.

U.S. Pat. No. 3,616,155 of Chavannes also teaches an insert comprised of a plurality of sealed air pocket, which does not provide for air movement.

U.S. Pat. No. 6,434,859 of Kim teaches a plurality of protrusions with a topmost aperture and a base skirt which under pressure collapses causing the egress of air from the base positioned cavity. This construction does not disclose a wall structure creating an interior ventable compartment and an exterior ventable compartment.

SUMMARY OF THE PRESENT INVENTION

A primary object of the present invention is to provide a disposable shoe insert that will cushion the foot during activity.

A further object of the present invention is to provide a disposable shoe insert incorporating an airflow generative function.

A yet further object of the present invention is to provide a disposable shoe insert having at least two layers comprising a cover layer and an open-cell shape-retentive layer.

A still yet further object of the present invention is to provide a disposable shoe insert having an optionally bottom layer serving as a frictional member to prevent displacement of the insert relative to the shoe insole during use.

Another object of the present invention is to provide a disposable shoe insert wherein the cover layer is a fibrous-material such as cloth and wherein the open-cell shape-retentive layer is made of a material taken from the group of polymeric, elastomeric or combination thereof.

Yet another object of the present invention is to provide a disposable shoe insert wherein the open-cell shape-retentive layer has the characteristic of returning to its original shape when a compression force is removed therefrom.

Yet another object of the present invention is to provide a disposable shoe insert wherein the open-cell shape-retentive layer is a silicon pad.

Still yet another object of the present invention is to provide a disposable shoe insert wherein the silicon pad has a cross linked fibrous body forming structure for interdisposed ambient air pockets.

An additional object of the present invention is to provide a disposable shoe insert wherein the open-cell shape-retentive layer is constructed of a plurality of open core truncated square pyramids.

A further object of the present invention is to provide a disposable shoe insert wherein the open core truncated square pyramids have an aperture passing through the top layer to the open core for channeling air from the open core to the exterior.

A yet further object of the present invention is to provide a disposable shoe insert wherein the cover layer as a plurality of apertures passing therethrough that co-align with the truncated square pyramid apertures to aid in channeling the air from the open core interior to the pad exterior.

A still yet further object of the present invention is to provide a disposable insert wherein the truncated square pyramids abut one another having a common base resulting in an insert with a small material base footprint.

Another object of the present invention is to provide a disposable insert wherein the truncated square pyramids are spaced one from the other thereby increasing the insert's base material footprint.

Additional objects of the present invention will appear as the description proceeds.

The present invention overcomes the shortcomings of the prior art by providing a disposable cushion inserts for shoes designed to temper forces imparted on a foot during activities such as walking and running. The cushion insert in one embodiment has a cover layer and an open-cell shape-retentive layer conjoined by means of a bonding method taken from the group of adhesives and ultrasonics and in a second instance has three layers by incorporating a base layer serving as a frictional member to keep the insert from positional displacement within the shoe during use.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
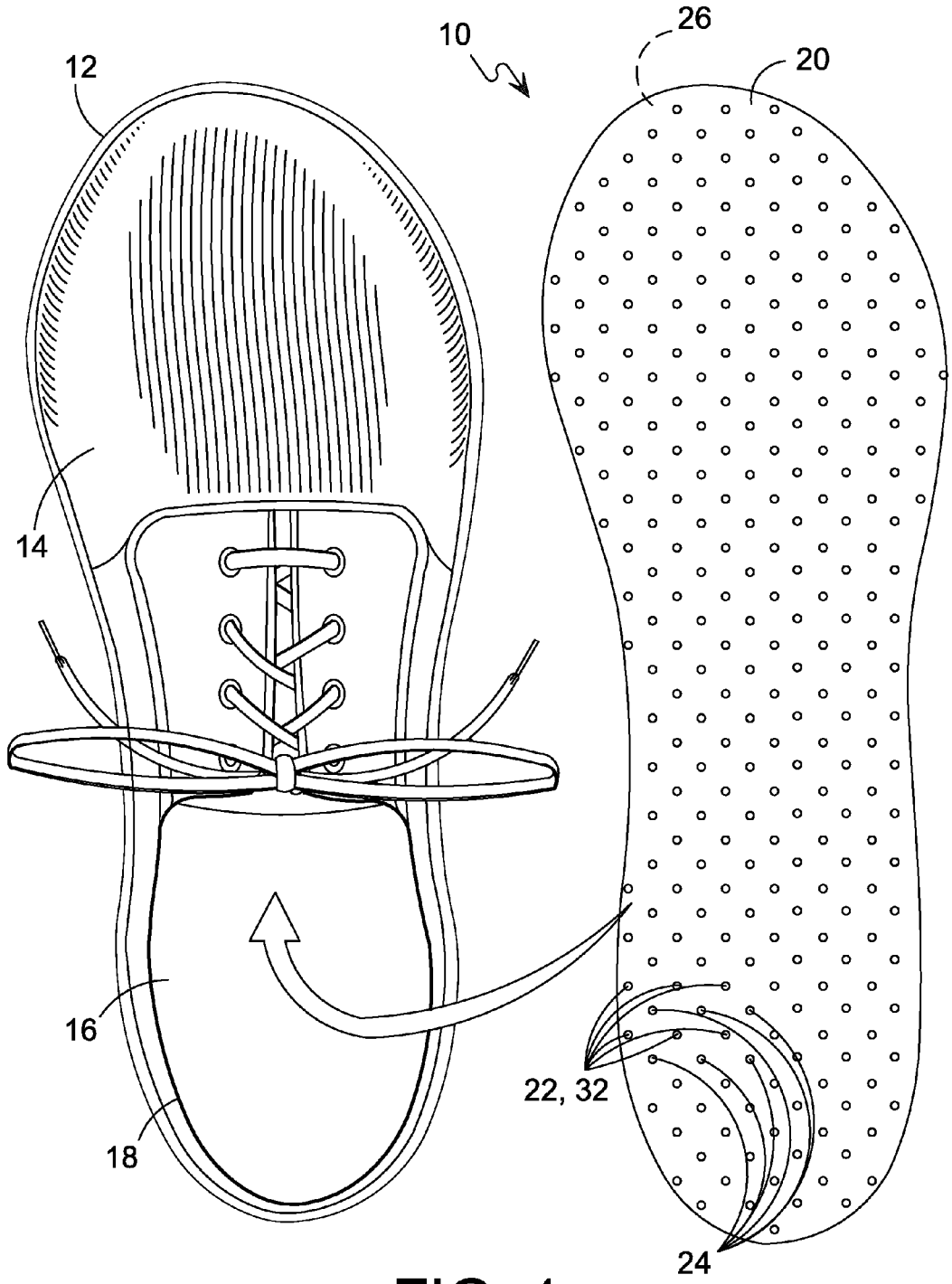
FIG. 1 is an illustrative view of the shoe insert and shoe application.

Turning now descriptively to the drawings, in which similar reference characters denote similar elements throughout the several views, the Figures illustrate the pedal operated toilet seat lifter of the present invention. With regard to the reference numerals used, the following numbering is used throughout the various drawing Figures.

10 cushioned shoe insert
12 shoe
14 vamp
16 sole
18 aperture
20 cover layer
22 coaligned aperture
24 aperture
26 open-cell shape-retentive layer
27 truncated square pyramid
28 truncated square pyramid sides
30 truncated square pyramid planar top
32 apex aperture
33 inter pyramid cavity
34 intra pyramid cavity
36 truncated square pyramid open core
38 foot
40 aperture
42 expelling air current
44 drawn air current
46 expansion force
48 compression force
50 frictional layer

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is a top view of the shoe insert and shoe application. Shoe 12 has a vamp 14 and rear 18 encompassing an inner sole 16 for the placement thereon of cushion insert 10 comprising cover layer 20 having apertures 22, 24 and a compressible layer 26 having apertures 32 that co-align with apertures 22 to facilitate air movement from the compressible layer 26 to the insert exterior surface.

Figure 2:
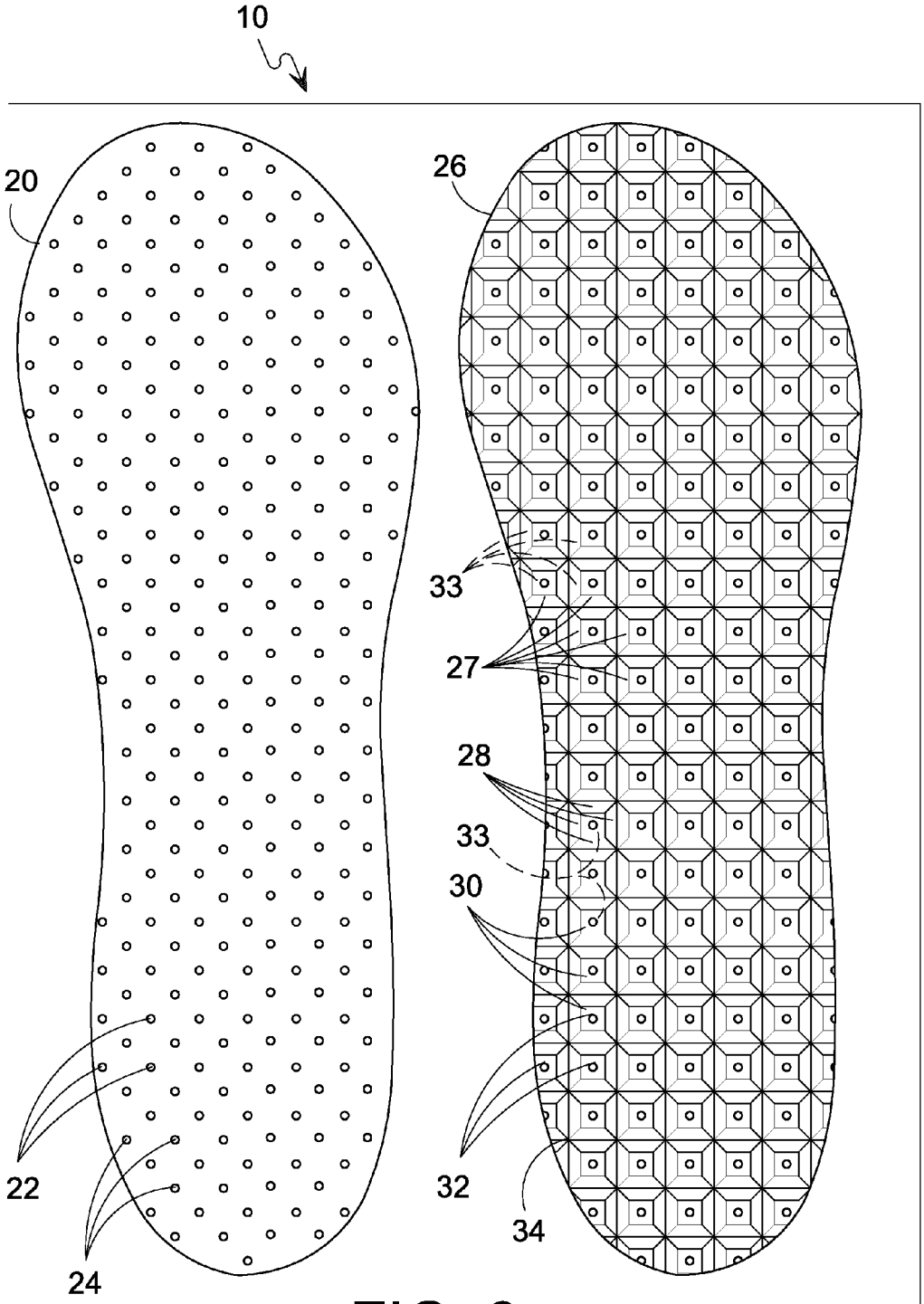
FIG. 2 is an illustrative view of the shoe insert of the present invention comprising in one instance of a top and bottom layer.

Referring to FIG. 2, shown is an exploded view of the cushion insert of the present invention. In one embodiment of the present invention the cushioned insert 10 is comprised of a top cover layer 20 superjacent an open-cell shape-retentive layer 26 manufactured of a cross-linked open-cell silicone forming a silicone pad. The top cover layer 20 has apertures 22 and apertures 24. The cover layer 20 is manufactured of a fibrous-material taken from the group of fiber crops, such as, cotton, jute, hemp, bamboo, ramie, kenaf and polymers that are treated to have a low moisture content and absorbency.

The cross-linked open-cell silicone layer 26 has a plurality of adjacently conjoined truncated-apex square pyramids 27 where the walls 28 enclose a central cavity 33 with open bottoms providing a structure that is mostly ambient air-filled space that when compressed expels the ambient air through cover layer apertures 22,32 and when released from a compressed state returns to its original truncated square pyramid form creating a vacuum which draws air into the structure through apertures 22,32. Each of the pyramids' truncated-apex top surfaces 30 has an aperture 32 placed therethrough providing passage for air between each of the pyramid-shaped cavities 33 and the cushioned-insert exterior.

Figure 3:
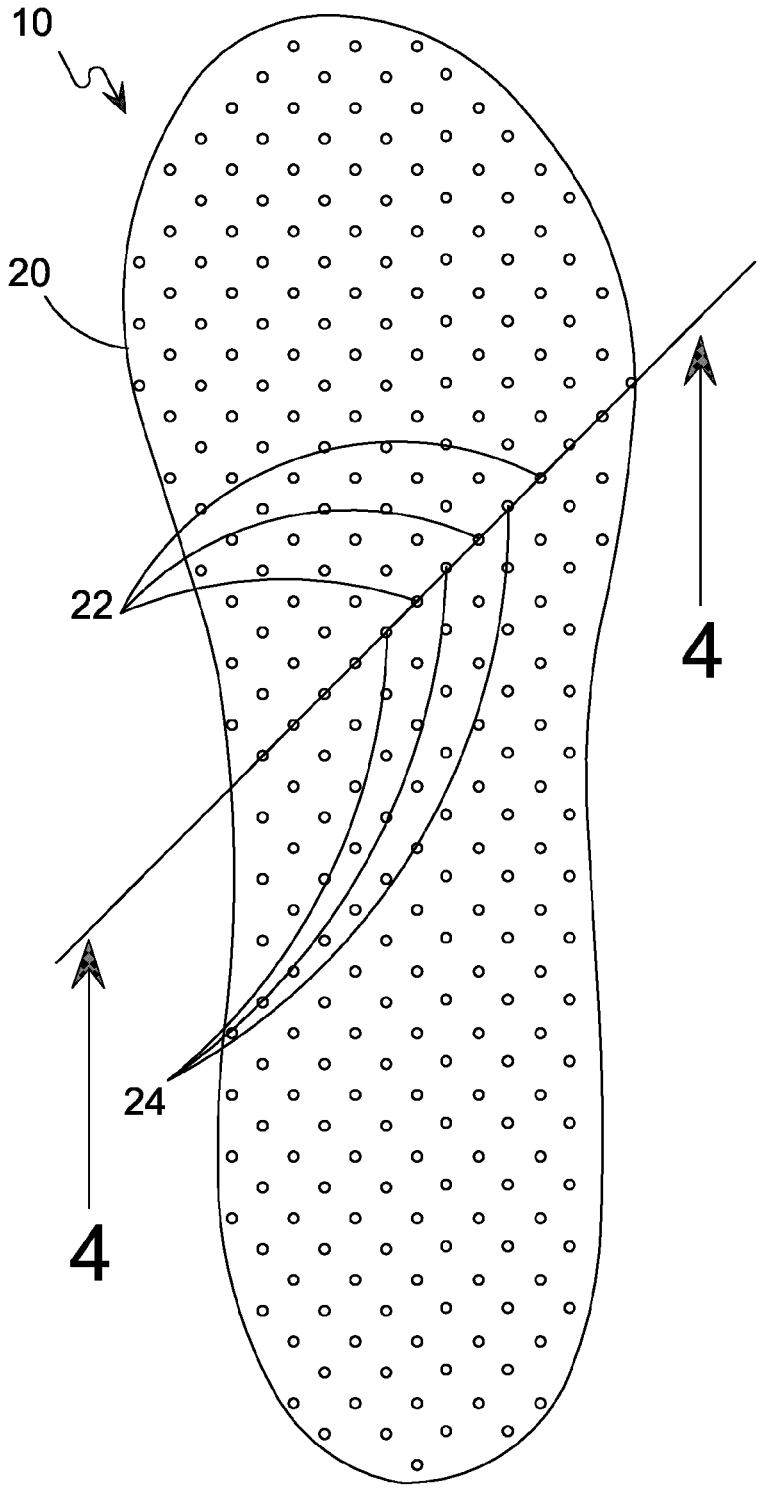
FIG. 3 is a top assembled view of the present invention.

Referring to FIG. 3, shown is a top assembled view of the present invention. The cover layer 20 is manufactured of a fibrous-material taken from the group of fiber crops, such as, cotton, jute, hemp, bamboo, ramie, kenaf and polymers that are treated to have a low moisture content and absorbency. A plurality of apertures 22,24 pass through the fibrous layer allowing air to pass between the exterior of the pad and the interior of the pad as compressive and decompressive forces act upon the open-cell shape-retentive layer. Some apertures co-align with the apertures of the truncated apex surface while other are located in the spaces between the square pyramid truncated apex surfaces, which will allow for a greater exchange of ambient air.

Figure 4:
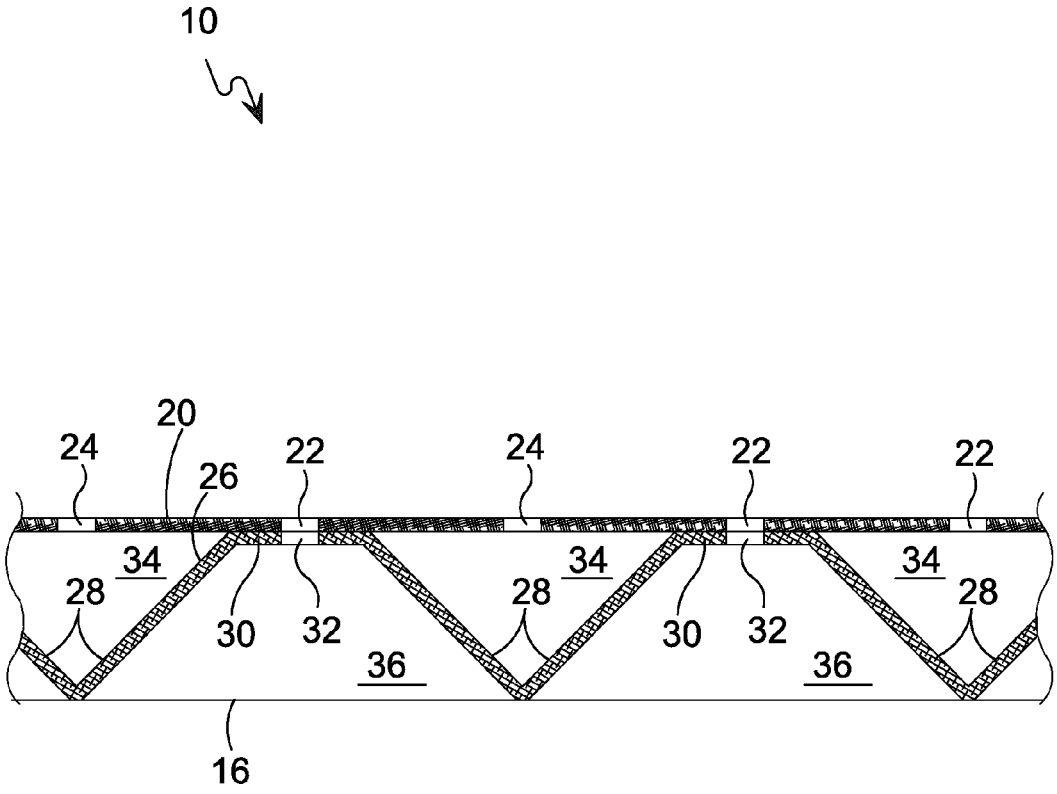
FIG. 4 is a sectional view of the present invention.

Referring to FIG. 4, shown is a sectional view 10 having a top cover layer 20 superjacent an open-cell shape-retentive layer 26 manufactured of a cross-linked open-cell silicone forming a silicone pad. The top cover layer 20 has apertures 22 and apertures 24. The cover layer 20 is manufactured of a fibrous-material taken from the group of fiber crops, such as, cotton, jute, hemp, bamboo, ramie, kenaf and polymers that are treated to have a low moisture content and absorbency. The cross-linked open-cell silicone layer 26 has a plurality of adjacently conjoined truncated-apex square pyramids 27 where the walls 28 enclose a central cavity 33 with open bottoms providing a structure that is mostly ambient air-filled space that when compressed expels the ambient air through cover layer apertures 22,32 and when released from a compressed state returns to its original truncated square pyramid form creating a vacuum which draws air into the structure through apertures 22,32. Each of the pyramids' truncated-apex top surfaces 30 has an aperture 32 placed therethrough providing passage for air between each of the pyramid-shaped cavities 33 and the cushioned-insert exterior.

Figure 5:
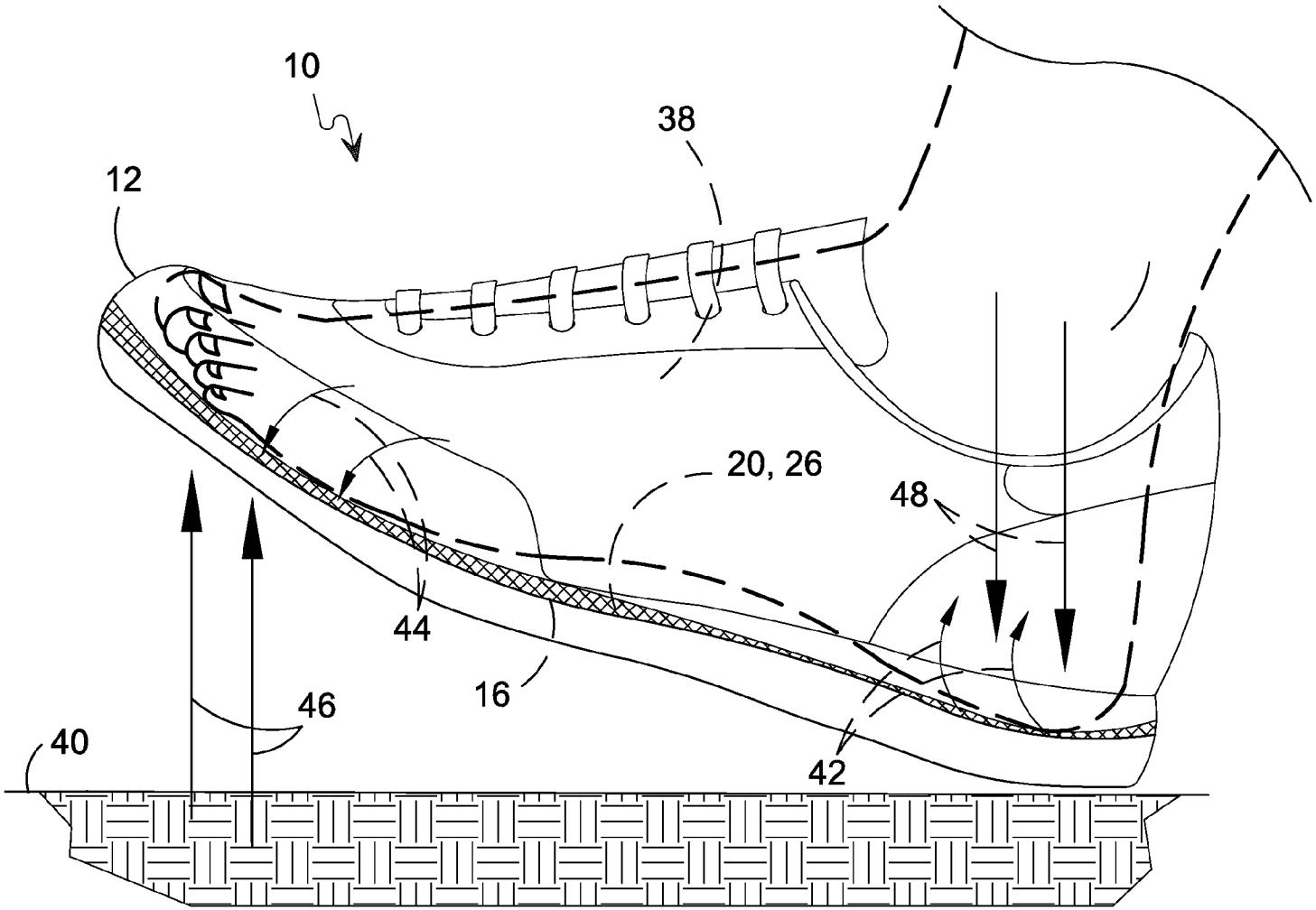
FIG. 5 is an illustrative view of the present invention in use.
Figure 6:
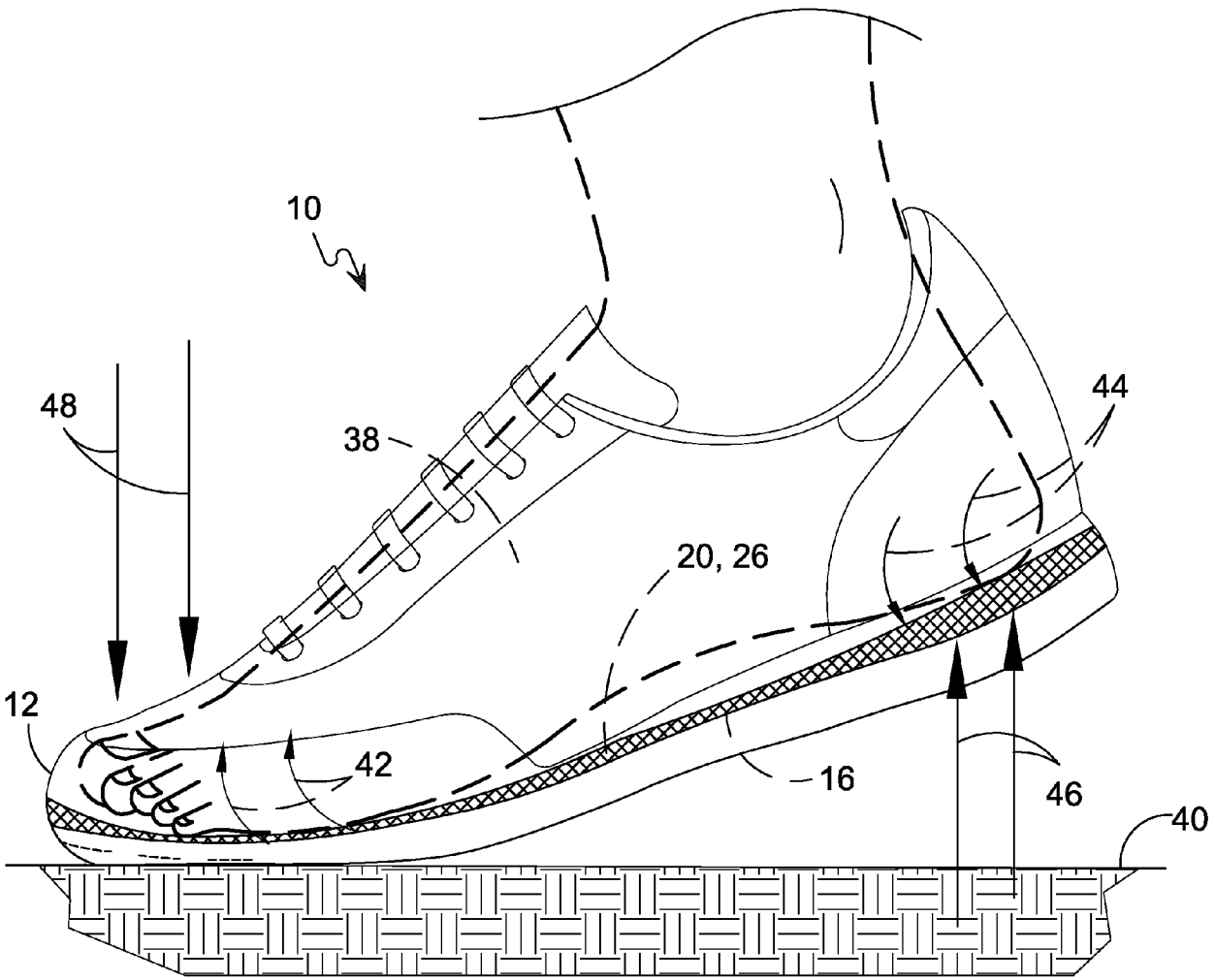
FIG. 6 is an illustrative view of the present invention in use.

Referring to FIGS. 5 and 6 shown are air current effected by compressive 44, 48 and decompressive 42, 46 forces made on the cushion 10 by the foot 38 during activity and a cushion designed to temper forces 40, 44, 48 imparted on a foot 38 during activities such as walking and running. The cover layer 20 is constructed of fibrous material taken from the group of fiber crops and polymers that will be treated to have a low moisture content and absorbency with a plurality of apertures passing therethrough as air passages between the open-cell layer and the cushioned insert exterior. The subjacent layer 26 is manufactured from a cross-linked open cell silicone material having a plurality of conjoined truncated-apex square pyramids where the walls enclose a central cavity with open bottoms providing a structure that is mostly ambient air-filled space that when released from a compressed state returns to its original form. Each of the pyramids' truncated-apex top surfaces has an aperture placed therethrough providing passage for air between each of the pyramid-shaped cavities and the cushioned-insert exterior. As aforementioned, both the cover and open-cell layers have a plurality of apertures with the pyramid apex apertures co-aligning with the cover layer apertures. Additional apertures are placed in the cover layer in fluid communication with the spaces between the second layer's spaced apart pyramids providing for additional venting of air from the open-cell layer through the cover to the cushioned insert exterior.

Figure 7:
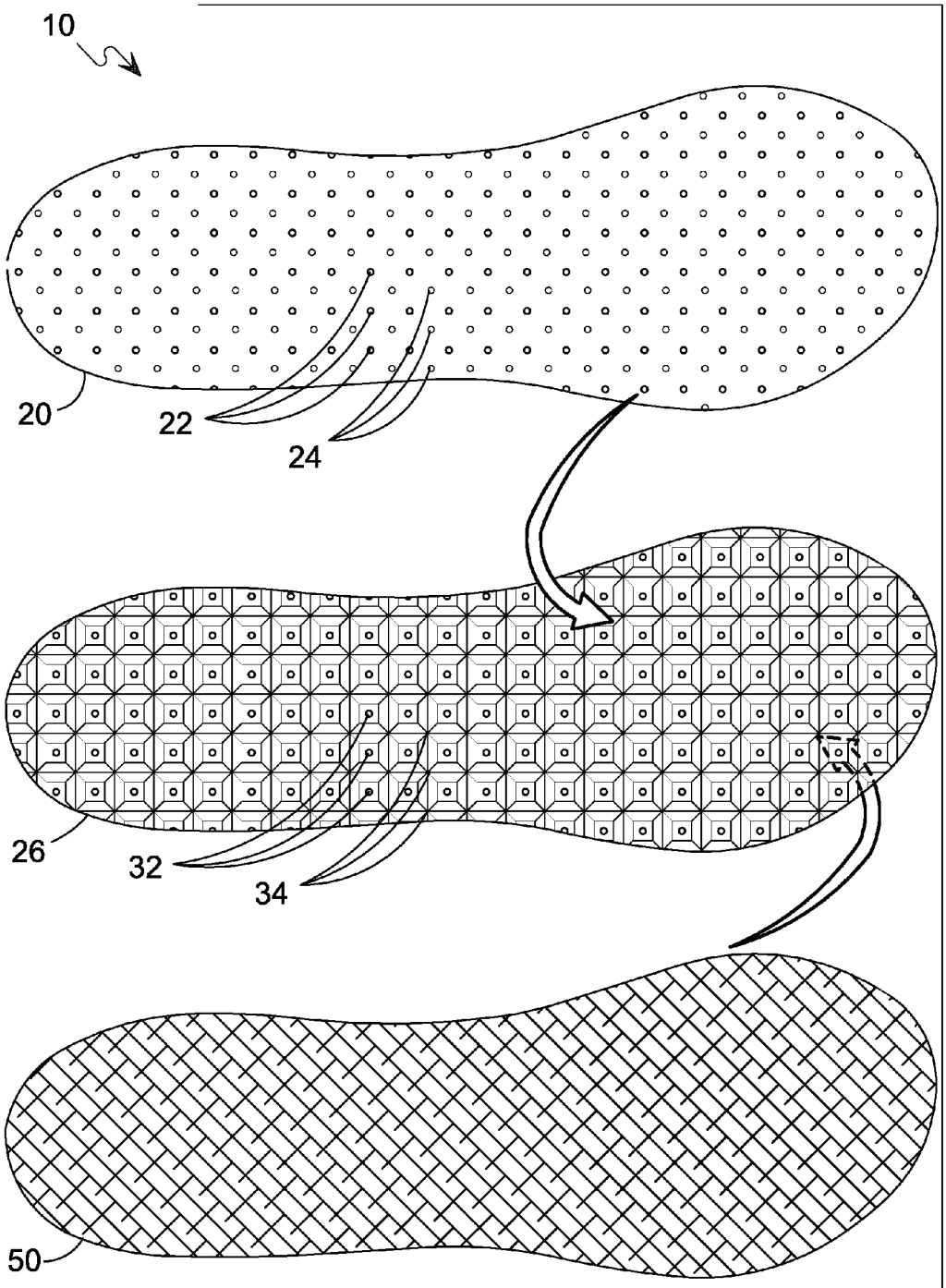
FIG. 7 is a top exploded view of a three layer shoe insert of the present invention.
Figure 8:
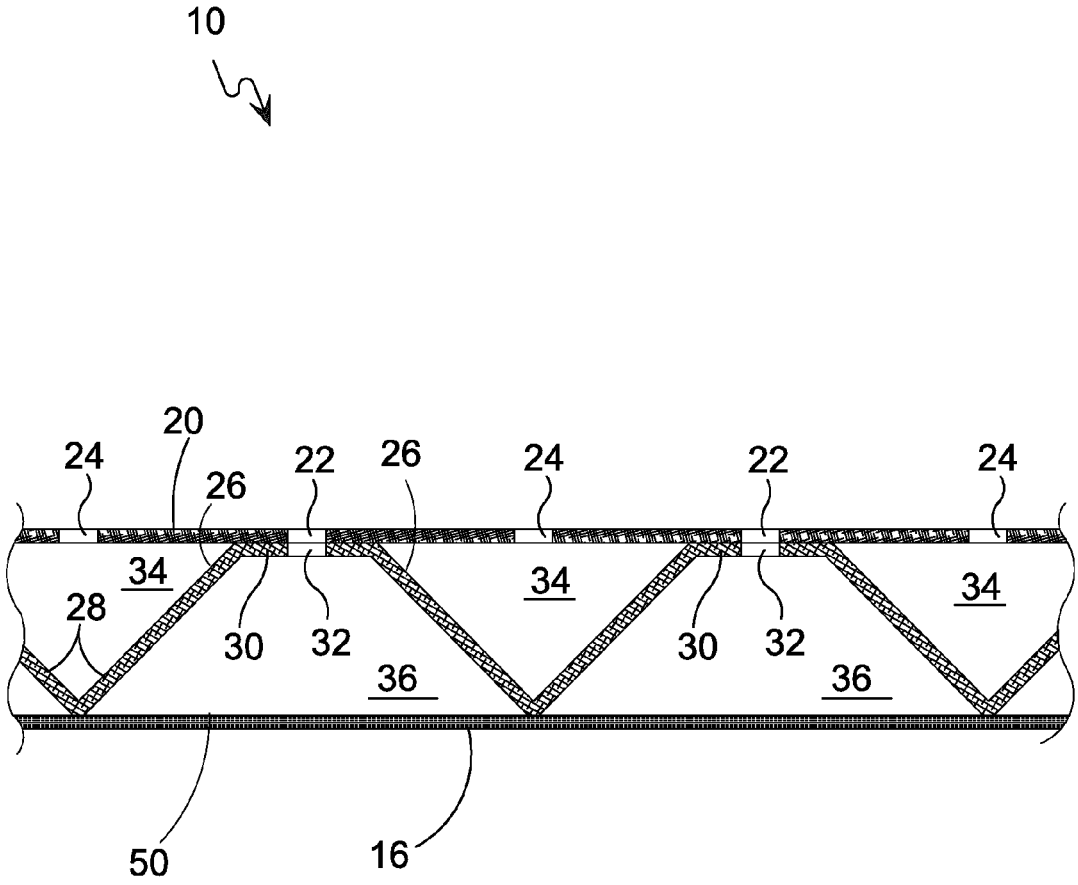
FIG. 8 is a sectional view of the additional instance of the present invention comprising three layers.

Referring to FIGS. 7 and 8 shown is a sectional view of an additional element of the present invention comprising a base layer 50 forming a frictional element to prevent casual displacement of the insert during use. The inset 10 having a top cover layer 20 superjacent an open-cell shape-retentive layer 26 manufactured of a cross-linked open-cell silicone forming a silicone pad. The top cover layer 20 has apertures 22 and apertures 24. The cover layer 20 is manufactured of a fibrous-material taken from the group of fiber crops, such as, cotton, jute, hemp, bamboo, ramie, kenaf and polymers that are treated to have a low moisture content and absorbency. The cross-linked open-cell silicone layer 26 has a plurality of adjacently conjoined truncated-apex square pyramids 27 where the walls 28 enclose a central cavity 33 with open bottoms providing a structure that is mostly ambient air-filled space that when compressed expels the ambient air through cover layer apertures 22,32 and when released from a compressed state returns to its original truncated square pyramid form creating a vacuum which draws air into the structure through apertures 22,32. Each of the pyramids' truncated-apex top surfaces 30 has an aperture 32 placed therethrough providing passage for air between each of the pyramid-shaped cavities 33 and the cushioned-insert exterior with the base layer 50 preventing casual displacement of the insert during use.

What is claimed is new and desired to be protected by Letters Patent is set forth in the appended claims:

1. A disposable shoe insert comprising:

a) a multi-layered pad having a cover layer comprising a fibrous-material with a plurality of apertures passing therethrough allowing for a free exchange of air between the exterior and interior of the pad;

b) a silicone open cell shape-retentive layer beneath said cover layer having a plurality of apertures subjacent the cover layer apertures aiding in the movement of air from the interior of the open cell shape-retentive layer through the cover layer to the exterior of the pad; and c) said open cell shape-retentive layer manufactured into a plurality of open core truncated square pyramids.

2. The insert as recited in claim 1 further comprising an aperture within the top surface of the truncated pyramid co-aligned with the cover layer apertures for channeling the air from the square pyramid open core to the exterior of the pad.

3. The insert as recited in claim 2 wherein said cover layer further provides further a plurality of additional apertures passing therethrough placed between the truncated square pyramids for channeling the air between the truncated square pyramids through the cover layer to the pad exterior.

4. The insert as recited in claim 1 wherein said cover layer is bonded to said open cell shape-retentive layer with said bonding taken from the group of adhesively and ultrasonically.

5. The insert as recited in claim 1 further comprising conjoining the truncated square pyramids with an adjoining common base to decrease the footprint of the airflow generative insert and thereby the necessary compression force to achieve a compressed state.

6. The insert as recited in claim 1 further comprising spacing the truncated square pyramids one from the other to increase the material surface footprint of the airflow generative insert that can act as a frictional element between the insert and the shoe insole.

7. The insert as recited in claim 1 further comprising a frictional material coating to prevent displacement of the insert relative to the shoe insole during use.

8. The insert as recited in claim 1 further comprising a bottom layer subjacent the open cell shape-retentive layer serving as a frictional member to prevent displace of the insert relative to the shoe insole during use.

9. The insert as recited in claim 8 wherein said bottom layer is bonded to said open cell shape-retentive layer with said bonding taken from the group of adhesively and ultrasonically.

* * * * *